US009511608B2

(12) United States Patent
Takenaka et al.

(10) Patent No.: US 9,511,608 B2
(45) Date of Patent: Dec. 6, 2016

(54) INKJET RECORDING APPARATUS

(71) Applicant: KYOCERA Document Solutions Inc., Osaka (JP)

(72) Inventors: Hidenori Takenaka, Osaka (JP); Takeshi Watanabe, Osaka (JP); Jumpei Hobo, Osaka (JP); Tomohisa Soda, Osaka (JP); Shinji Yoshinaga, Osaka (JP); Hiroatsu Tamai, Osaka (JP); Satoshi Tsunemi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/965,090

(22) Filed: Dec. 10, 2015

(65) Prior Publication Data

US 2016/0176211 A1 Jun. 23, 2016

(30) Foreign Application Priority Data

Dec. 17, 2014 (JP) ..... 2014-255257

(51) Int. Cl.
*B41J 29/17* (2006.01)
*B41J 11/00* (2006.01)

(52) U.S. Cl.
CPC ..... *B41J 29/17* (2013.01); *B41J 11/007* (2013.01); *B41J 11/0085* (2013.01)

(58) Field of Classification Search
CPC ..... B41J 25/308
See application file for complete search history.

(56) References Cited

U.S. PATENT DOCUMENTS

2011/0102506 A1* 5/2011 Yamada ..... B41J 11/0065 347/37
2012/0056925 A1* 3/2012 Yamagishi ..... B41J 2/155 347/14

FOREIGN PATENT DOCUMENTS

JP 2008-213255 A 9/2008

* cited by examiner

*Primary Examiner* — Alessandro Amari
*Assistant Examiner* — Roger W Pisha, II
(74) *Attorney, Agent, or Firm* — Studebaker & Brackett PC

(57) ABSTRACT

An inkjet recording apparatus includes a control section, a conveyance section, a recording head, a gap forming section, and a negative pressure applying section. The gap forming section is disposed upstream of the recording head in a conveyance direction of a recording medium to form a narrow gap with a conveying surface of the conveyance section. The negative pressure applying section applies negative pressure to the narrow gap. The control section adjusts a distance across the narrow gap in the direction perpendicular to the conveying surface to a first distance in image formation. Upon receiving an instruction to clean the gap forming section, the control section adjusts the distance across the narrow gap in a direction perpendicular to the conveying surface to a second distance that is greater than the first distance and causes the negative pressure applying section to start applying negative pressure to the narrow gap.

20 Claims, 11 Drawing Sheets

INKJET RECORDING APPARATUS

INCORPORATION BY REFERENCE

The present application claims priority under 35 U.S.C. §119 to Japanese Patent Application No. 2014-255257, filed on Dec. 17, 2014. The contents of this application are incorporated herein by reference in their entirety.

BACKGROUND

The present disclosure relates to inkjet recording apparatuses.

An inkjet apparatus that ejects ink onto a recording medium may address a problem of nozzle clogging in a recording head by adopting a known paper dust removal technique.

An inkjet recording apparatus of one known example is provided with a paper dust collector located upstream of a recording head in a conveyance direction of a recording medium. The paper dust collector has a vertical wall and a downstream wall. The vertical wall stands vertically upward. The downstream wall extends from the top end of the vertical wall in a downstream direction in the conveyance direction of the recording medium.

The paper dust collector collects paper dust generated during conveyance of the recording medium before the paper dust reaches the recording head. This can reduce subsequent attachment of paper dust to the recording head.

SUMMARY

An inkjet recording apparatus according to the present disclosure includes a control section, a conveyance section, a recording head, a gap forming section, and a negative pressure applying section. The conveyance section has a conveying surface and is configured to convey the recording medium while the recording medium is placed on the conveying surface. The recording head is configured to eject ink onto the recording medium being conveyed by the conveyance section. The gap forming section is disposed upstream of the recording head in a conveyance direction of the recording medium to form a narrow gap with the conveying surface of the conveyance section. The negative pressure applying section is configured to apply negative pressure to the narrow gap. A distance across the narrow gap in a direction perpendicular to the conveying surface is set so as to allow air flowing into the narrow gap from surrounding space to have a higher flow velocity in the narrow gap than before flowing into the narrow gap. The control section adjusts the distance across the narrow gap in the direction perpendicular to the conveying surface to a first distance in image formation. Upon receiving an instruction to clean the gap forming section, the control section adjusts the distance across the narrow gap in the direction perpendicular to the conveying surface to a second distance that is shorter than the first distance and causes the negative pressure applying section to start applying negative pressure to the narrow gap.

DETAILED DESCRIPTION

Figure 1:
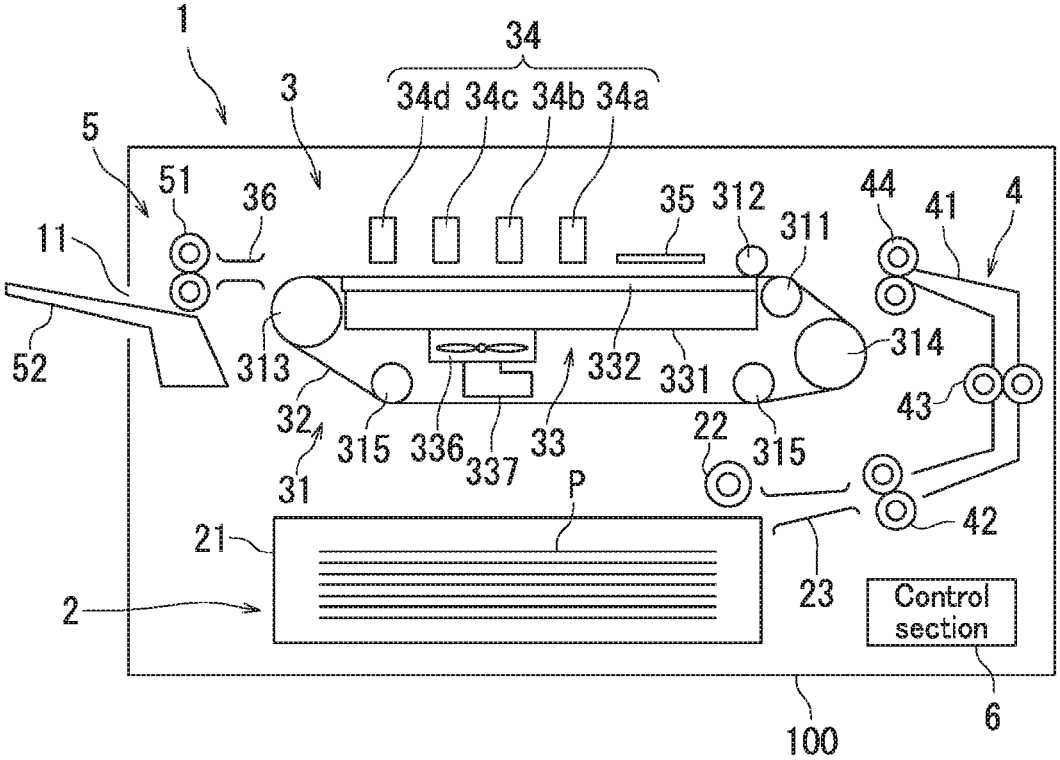
FIG. 1 illustrates structure of an inkjet recording apparatus according to an embodiment.

The following describes an embodiment of the present disclosure with reference to the accompanying drawings. In the drawings, like reference signs represent similar or corresponding components and explanation thereof is not repeated.

First, an inkjet recording apparatus 1 according to the present embodiment will be described with reference to FIG. 1. FIG. 1 illustrates structure of the inkjet recording apparatus 1 according to the present embodiment. The inkjet recording apparatus 1 includes an apparatus housing 100, a sheet feed section 2 disposed in a lower part of the apparatus housing 100, an image forming section 3 disposed above the sheet feed section 2, a sheet conveyance section 4 disposed at one side of the image forming section 3 (right side in FIG. 1), and a sheet ejecting section 5 disposed on the other side of the image forming section 3 (left side in FIG. 1).

The sheet feed section 2 includes a sheet feed cassette 21, a sheet feed roller 22, and a guide plate 23. The sheet feed cassette 21 is for storing recording sheets P and is attachable to and detachable from the apparatus housing 100. The sheet feed roller 22 is located above one end of the sheet feed cassette 21 (right end in FIG. 1). The guide plate 23 extends between the sheet feed roller 22 and the sheet conveyance section 4.

The sheet feed cassette 21 is loaded with a plurality of recording sheets P. In the following description, a recording sheet P is referred to simply as a "sheet" for the sake of convenience. A sheet P is an example of a "recording medium". The sheet feed roller (pickup roller) 22 feeds sheets P one at a time in a conveyance direction of the sheet P by picking up the uppermost sheet P stored in the sheet feed cassette 21. The guide plate 23 guides the sheet P picked up by the sheet feed roller 22 to the sheet conveyance section 4.

The sheet conveyance section 4 includes a sheet conveyance path 41 substantially defining a C-shape, a pair of first conveyance rollers 42 located at the entry of the sheet conveyance path 41, a pair of second conveyance rollers 43 located at an intermediate location on the sheet conveyance path 41, and a pair of registration rollers 44 located at the exit of the sheet conveyance path 41.

The pair of first conveyance rollers 42 is a pair of rollers (a pair of feed rollers) that feeds a sheet P in the conveyance direction of the sheet P. The sheet P fed from the sheet feed section 2 is caught between the pair of first conveyance rollers 42 and forwarded to the sheet conveyance path 41. The pair of second conveyance rollers 43 is also a pair of feed rollers. The sheet P forwarded from the pair of first conveyance rollers 42 is caught between the pair of second conveyance rollers 43 and forwarded toward the pair of registration rollers 44.

The pair of registration rollers 44 performs skew correction on the sheet P having been conveyed by the second conveyance rollers 43. The pair of registration rollers 44 temporarily holds the sheet P to synchronize the conveyance of the sheet P with image formation, and then feeds the sheet P to the image forming section 3 in accordance with timing of the image formation.

The image forming section 3 includes a conveyor belt 32 and recording heads 34. The conveyor belt 32 conveys the sheet P fed from the pair of registration rollers 44 in a predetermined direction (leftward in FIG. 1). The recording heads 34 form an image on the sheet P being conveyed on the conveyor belt 32. Detailed structure of the image forming section 3 will be described later with reference to FIG. 2. The image forming section 3 additionally includes a conveyance guide 36 located downstream (to the left in FIG. 1) of the recording heads 34 in the conveyance direction of the sheet P.

The conveyance guide 36 guides the sheet P discharged from the conveyor belt 32 to the sheet ejecting section 5. The sheet ejecting section 5 includes a pair of ejection rollers 51 and an exit tray 52. The exit tray 52 is secured to the apparatus housing 100 so as to protrude outward from an exit port 11 formed in the apparatus housing 100.

The pair of ejection rollers 51 forwards the sheet P toward the exit port 11 after the sheet P passes through the conveyance guide 36. The exit tray 52 guides the sheet P ejected by the pair of ejection rollers 51. The sheet P is ejected out of the apparatus housing 100 by the pair of ejection rollers 51 through the exit port 11 formed in a side surface of the apparatus housing 100 (a left side surface in FIG. 1). The sheet P ejected through the exit port 11 is stacked in the exit tray 52.

Figure 2:
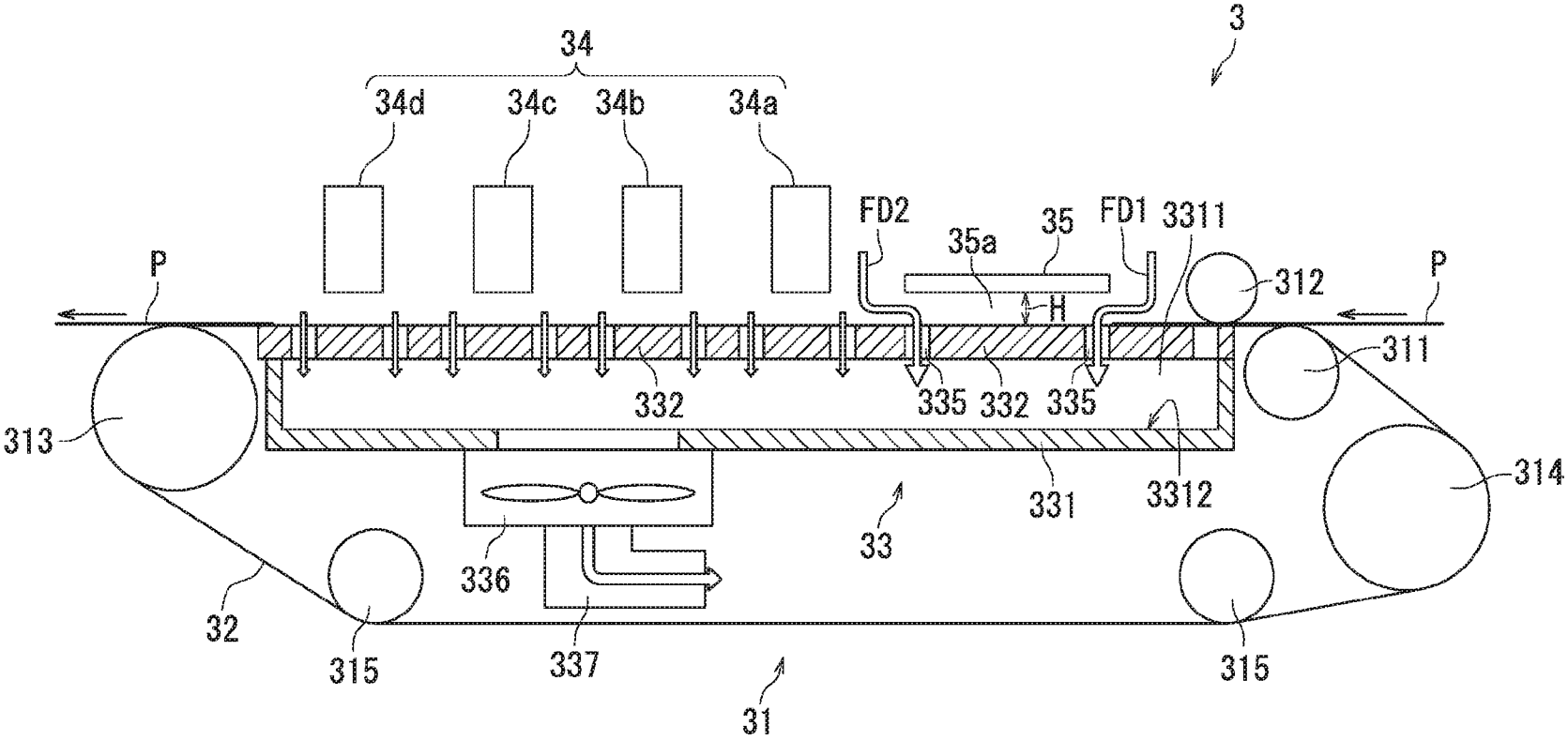
FIG. 2 is a diagram illustrating a first example of structure of an image forming section illustrated in FIG. 1.

Next, a description will be given of the image forming section 3 with reference to FIG. 2. FIG. 2 is a diagram illustrating a first example of the structure of the image forming section 3 illustrated in FIG. 1. FIG. 2 is for depicting main elements of configuration in the image forming section 3 and does not illustrate nonessential elements of configuration in the image forming section 3. Some of the elements of configuration not illustrated in FIG. 2 will be described later with reference to FIGS. 8-10.

As illustrated in FIG. 2, the image forming section 3 includes a conveyance section 31, a negative pressure applying section 33, the recording heads 34, and a plate member 35. The recording heads 34, which specifically are four types of recording heads 34*a*, 34*b*, 34*c*, and 34*d*, each include a plurality of nozzles (not illustrated). Ink is ejected through the plurality of nozzles so as to form images such as characters and figures on a sheet P. The recording heads 34*a*, 34*b*, 34*c*, and 34*d* are substantially identical in structure and may therefore be generally referred to as recording heads 34 without distinguishing therebetween.

The conveyance section 31 conveys a sheet P in a predetermined direction (leftward in FIG. 2) and includes a belt speed detecting roller 311, a placing roller 312, a drive roller 313, a tension roller 314, a pair of guide rollers 315, and the conveyor belt 32.

The conveyance section 31 is located opposite to the four types of recording heads 34 (34*a*, 34*b*, 34*c*, and 34*d*) in the apparatus housing 100. The conveyor belt 32 is stretched around the belt speed detecting roller 311, the drive roller 313, the tension roller 314, and the pair of guide rollers 315. The conveyor belt 32 is driven to circulate in the conveyance direction of the sheet P (counterclockwise in FIG. 2) to convey the sheet P. The conveyor belt 32 is an example of an "endless belt".

The tension roller 314 tensions the conveyor belt 32 in order to prevent sagging of the conveyor belt 32.

The belt speed detecting roller 311 is located upstream (to the right in FIG. 2) of the negative pressure applying section 33 in the conveyance direction of the sheet P and rotates by friction with the conveyor belt 32. The belt speed detecting roller 311 includes a pulse plate (not illustrated) that integrally rotates with the belt speed detecting roller 311. The circulation speed of the conveyor belt 32 is measured by measuring the rotational speed of the pulse plate.

The drive roller 313 is located downstream (to the left in FIG. 1) of the negative pressure applying section 33 in the conveyance direction of the sheet P. The drive roller 313 is preferably located in cooperating relation with the belt speed detecting roller 311 so as to ensure the flatness of the conveyor belt 32 at regions opposite to the recording heads 34.

The drive roller 313 is driven to rotate by a motor (not illustrated) to circulate the conveyor belt 32 counterclockwise in FIG. 2.

The pair of guide rollers 315 is located below the negative pressure applying section 33 to secure space below the negative pressure applying section 33. This arrangement can prevent a portion of the conveyor belt 32 below the negative pressure applying section 33 from touching the negative pressure applying section 33.

The four types of recording heads 34 (34*a*, 34*b*, 34*c*, and 34*d*) are arranged in order from upstream to downstream in the conveyance direction of the sheet P. The recording heads 34*a*, 34*b*, 34*c*, and 34*d* each include a plurality of nozzles (not illustrated) arranged in a width direction of the conveyor belt 32 (direction perpendicular to the drawing surface in FIG. 2). The recording heads 34*a*, 34*b*, 34*c*, and 34*d* are referred to as a line type recording heads. From this follows that the inkjet recording apparatus 1 is a line head inkjet recording apparatus.

The negative pressure applying section 33 applies negative pressure to the sheet P through the conveyor belt 32, causing the sheet P to be sucked onto the conveyor belt 32. The negative pressure applying section 33 is located on the rear surface (underside in FIG. 2) of the conveyor belt 32 and opposite to the four types of recording heads 34 with the conveyor belt 32 therebetween. The negative pressure applying section 33 includes an airflow chamber 331 that is open at the top, a guide member 332 that closes the open top of the airflow chamber 331, a negative pressure creating section 336, and a gas outlet 337.

The placing roller 312 is a driven roller. The placing roller 312 is located opposite to the guide member 332 with the conveyor belt 32 therebetween. The placing roller 312 guides the sheet P that has been fed from the pair of registration rollers 44 onto the conveyor belt 32 so that the sheet P is sucked onto the conveyor belt 32.

The guide member 332 supports the sheet P through the conveyor belt 32. The guide member 332 is an example of a "conveyor plate". The guide member 332 has through holes 335. The guide member 332 is formed from, for example, a metallic material. Specifically, the guide member 332 may be made from die-cast aluminum or a pressed metal plate. Alternatively, the guide member 332 may be made from resin to provide excellent slidability of the guide member 332 against the conveyor belt 32. Although grooves 334 (see FIGS. 3, 4, etc.) formed in an upper surface of the guide member 332 are not illustrated in FIG. 2, the through holes 335 in the present embodiment are each located in a bottom surface of a corresponding one of the grooves 334.

For the sake of convenience, the present embodiment describes the guide member 332 as part of the negative pressure applying section 33. Alternatively, however, the guide member 332 may be described as part of the conveyance section 31 because the guide member 332 supports the conveyor belt 32 as described above.

The airflow chamber 331 forms a space (hereinafter referred to as a "negative pressure creation space") 3311 in which negative pressure for sucking the sheet P is created. The airflow chamber 331 in the present embodiment is a box-shaped member that is a tube having an open top and a closed bottom. The airflow chamber 331 has side walls that are secured at the top to the guide member 332. The open top of the airflow chamber 331 is covered with the guide member 332. That is, the guide member 332 in the present embodiment serves as an upper wall of the airflow chamber 331. As will be described later with reference to FIG. 8, the airflow chamber 331 (the negative pressure creation space 3311) in the present embodiment is partitioned into two spaces.

The negative pressure creating section 336 creates negative pressure in the airflow chamber 331, and may for example be a fan or a vacuum pump. The negative pressure creating section 336 is disposed under the airflow chamber 331, specifically, connected to the bottom surface 3312 of the airflow chamber 331. The negative pressure creating section 336 creates negative pressure in the airflow chamber 331 by discharging air outward of the airflow chamber 331 from the gas outlet 337. The negative pressure created in the airflow chamber 331 acts on the sheet P through suction holes 321 (see FIG. 4) in the conveyor belt 32 and the through holes 335 in the guide member 332 to suck the sheet P onto the conveyor belt 32. As a result, the sheet P is sucked on the conveyor belt 32. In the above manner, the conveyance section 31 conveys the sheet P while sucking the sheet p onto the conveyor belt 32.

Although FIG. 2 illustrates only one negative pressure creating section 336 and only one gas outlet 337, the negative pressure applying section 33 in the present embodiment includes two negative pressure creating sections 336 and two gas outlets 337, as will be described later. The negative pressure creating sections 336 and the gas outlets 337 each are provided in a corresponding one of the two spaces in the airflow chamber 331.

The plate member 35 is located upstream of the recording heads 34 in the conveyance direction of the sheet P (to the right in FIG. 2). In other words, the plate member 35 is located between the recording head 34*a* and the placing roller 312. The plate member 35 corresponds to part of a "gap forming section". A gap present between the lower surface of the plate member 35 and the upper surface of the conveyor belt 32 is a narrow gap 35*a*, which will be described later.

Next, a description will be given of operation of the inkjet recording apparatus 1 with reference to FIG. 1. First, the sheet feed roller 22 picks up a sheet P from the sheet feed cassette 21. The sheet P is then guided by the guide plate 23 to the pair of first conveyance rollers 42.

The sheet P is fed by the pair of first conveyance rollers 42 into the sheet conveyance path 41 and then conveyed by the pair of second conveyance rollers 43 in the conveyance direction of the sheet P. The sheet P comes to stop upon contact with the pair of registration rollers 44 where skew correction of the sheet P is performed. The sheet P is subsequently fed to the image forming section 3 by the pair of registration rollers 44 in synchronization with timing of image formation.

The sheet P is guided to the conveyor belt 32 by the placing roller 312 and sucked onto the conveyor belt 32. Preferably, the sheet P is guided to the conveyor belt 32 such that the widthwise center of the sheet P coincides with the widthwise center of the conveyor belt 32. The sheet P covers some of the suction holes 321 (see FIG. 4) in the conveyor belt 32. The negative pressure applying section 33 sucks air through the guide member 332 and the conveyor belt 32. That is, the negative pressure applying section 33 creates negative pressure in the airflow chamber 331. The negative pressure acts on the sheet P and thus the sheet P is sucked onto the conveyor belt 32. The sheet P is conveyed in the conveyance direction of the sheet P as the conveyor belt 32 circulates.

The sheet P is then conveyed on the conveyor belt 32 sequentially to the regions opposite to the four types of recording heads 34*a*, 34*b*, 34*c*, and 34*d*. While the sheet P is conveyed on the conveyor belt 32, the four types of recording heads 34*a*, 34*b*, 34*c*, and 34*d* eject ink of respective colors toward the sheet P. This forms an image on the sheet P.

The sheet P is conveyed from the conveyor belt 32 to the conveyance guide 36. Once passed through the conveyance guide 36, the sheet P is fed toward the exit port 11 by the pair of ejection rollers 51 and ejected through the exit port 11 to be guided along the exit tray 52 out of the apparatus housing 100.

Figure 3:
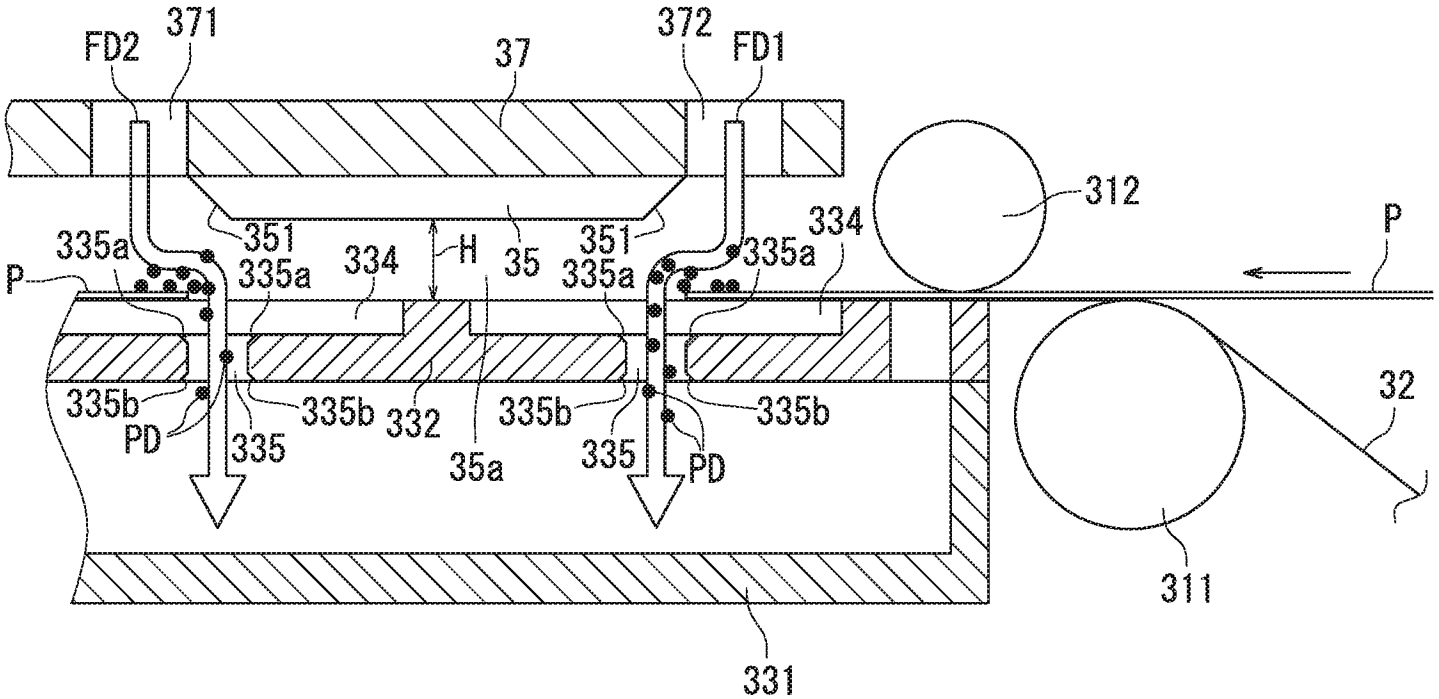
FIG. 3 illustrates structure around a plate member illustrated in FIG. 2.

Next, a description will be given of structure around the plate member 35 with reference to FIG. 3. FIG. 3 illustrates the structure around the plate member 35 illustrated in FIG. 2.

As illustrated in FIG. 3, the plate member 35 is secured to a head base 37. The head base 37 is a plate-like member for securing the recording heads 34 in place. The head base 37 corresponds to part of the "gap forming section". A distance H (perpendicular distance) across the narrow gap 35*a* is set so as to allow air flowing into the narrow gap 35*a* from surrounding space to have a higher flow velocity in the narrow gap 35*a* than before flowing into the narrow gap 35*a*. The distance H herein is a length of the narrow gap 35*a* in a direction perpendicular to the upper surface of the conveyor belt 32. In other words, the distance H is a vertical length of the narrow gap 35*a*. Specifically, the narrow gap 35*a* is formed between the lower surface of the plate member 35 and the upper surface of the conveyor belt 32 such that the distance H is equal to or shorter than a threshold distance HS that is set in advance (for example, 3 mm). The plate member 35 is formed from an electrical conductor (for example, stainless steel) that is earthed at at least a lower surface thereof. The upper surface of a part of the conveyor belt 32 that is in contact with the guide member 332 is an example of a "conveying surface".

The inkjet recording apparatus 1 controls a raising and lowering mechanism (not illustrated) to raise and lower the plate member 35. In the inkjet recording apparatus 1 in the present embodiment, the distance H is set at a first distance (for example, 2 mm) in image formation. By contrast, the distance H is set at a second distance shorter than the first distance (for example, 1.5 mm) in maintenance for cleaning the plate member 35 (hereinafter referred to simply as 'in maintenance').

The above description with reference to FIG. 3 is directed to a situation in which the sheet P has a thickness sufficiently thinner than the distance H. However, the distance H may be changed according to the thickness of a sheet P. Specifically, for example, it is preferable to raise and lower the plate member 35 according to the thickness of the sheet P to keep the distance between the upper surface of the sheet P and the lower surface of the plate member 35 substantially constant (for example, 2 mm) in image formation.

The head base 37 has holes 371 and 372 for allowing air to flow into the narrow gap 35*a*. The hole 371 is located downstream (to the left in FIG. 3) of the plate member 35 in the conveyance direction of the sheet P, and the hole 372 is located upstream (to the right in FIG. 3). The holes 371 and 372 are elongated in the width direction of the sheet P (direction perpendicular to the drawing surface of FIG. 3).

The present embodiment is directed to a configuration in which the head base 37 has the holes 371 and 372 elongated in the width direction of the sheet P. Alternatively, however, the head base 37 may have holes having a different shape. The head base 37 may for example have a plurality of substantially cylindrical holes arranged in the width direction of the sheet P.

The holes 371 and 372 in the head base 37 allow air to flow into the narrow gap 35*a* and then into the airflow chamber 331 sequentially through the suction holes 321 in the conveyor belt 32 and the through holes 335 in the guide member 332. In other words, the airflow chamber 331 is under negative pressure created by the negative pressure creating section 336 relative to the atmospheric pressure (for example, at a pressure differing from the atmospheric pressure by about 0.005 atm z about 500 Pa). Therefore, air present in the narrow gap 35*a* is drawn into the airflow chamber 331 sequentially through the suction holes 321 in the conveyor belt 32 and the through holes 335 in the guide member 332. In addition, as air is drawn out of the narrow gap 35*a* to the airflow chamber 331, air is drawn into the narrow gap 35*a* through the holes 371 and 372 in the head base 37.

As described above, air flows along paths indicated by arrows FD1 and FD2 in FIG. 3. In addition, the distance H across the narrow gap 35*a* is set to be equal to or shorter than the threshold distance HS that is set in advance. Consequently, the flow velocity increases in the narrow gap 35*a*. The flow velocity in the narrow gap 35*a* is preferably at least 6.0 m/sec, for example.

As described above, air blowing along the path indicated by the arrow FD1 flows from upstream to downstream in the conveyance direction of the sheet P in the narrow gap 35*a* (to the left in FIG. 3). Consequently, as illustrated in FIG. 3, paper dust PD attached to the leading edge (left edge in FIG. 3) of the sheet P can be removed and collected into the airflow chamber 331. By contrast, air blowing along the path indicated by the arrow FD2 flows from downstream to upstream in the conveyance direction of the sheet P in the narrow gap 35*a* (to the right in FIG. 3). Consequently, paper dust PD attached to the trailing edge (right edge in FIG. 3) of the sheet P can be removed and collected into the airflow chamber 331. This can ensure effective removal of paper dust attached to the sheet P.

As described above, the plate member 35 is formed from an earthed electrical conductor and thus will not be charged. Therefore, the plate member 35 can be ensured not to attract paper dust even though the paper dust may be charged.

As described above, attachment of the plate member 35 can be facilitated by securing the plate member 35 to the head base 37. In addition, the head base 37 has the holes 371 and 372 allowing air to flow into the narrow gap 35*a* and thus is able to ensure smooth flow of air into the narrow gap 35*a*.

The present embodiment is directed to a configuration in which the plate member 35 is secured to the head base 37. Alternatively, however, the plate member 35 may be secured to the apparatus housing 100 illustrated in FIG. 1. For example, the apparatus housing 100 may be provided with a securing member extended therefrom to hold the plate member 35 at opposite ends in the width direction of the plate member 35 (direction perpendicular to the drawing surface of FIG. 3). In this configuration, no component member obstructs air flowing into the narrow gap 35*a* from downstream and upstream in the conveyance direction of the sheet P. Therefore, the flow velocity of air in the narrow gap 35*a* can increase to a greater extent. Consequently, paper dust can be removed more effectively.

As illustrated in FIG. 3, the plate member 35 has tapered portions 351 such that the distance H is greater toward either edge of the plate member 35 in the conveyance direction of the sheet P (horizontal direction in FIG. 3). One of the tapered portions 351 that is on the right in FIG. 3 is formed such that the distance H is greater toward the upstream edge of the plate member 35 in the conveyance direction of the sheet P (the horizontal direction in FIG. 3). The other tapered portion 351 that is on the left in FIG. 3 is formed such that the distance H is greater toward the downstream edge of the plate member 35 in the conveyance direction of the sheet P (the horizontal direction in FIG. 3). In other words, the tapered portions 351 are formed at an upstream end and a downstream end of the plate member 35 in the conveyance direction of the sheet P such that the plate member 35 is thinner toward either edge of the plate member 35 in the conveyance direction of the sheet P.

As described above, the plate member 35 has the tapered portions 351 such that the distance H is greater toward either edge of the plate member 35 in the conveyance direction of the sheet P (horizontal direction in FIG. 3). This configuration enables reduction in pressure loss of air flowing along the plate member 35. Therefore, the flow velocity of air in the narrow gap 35*a* can increase, thereby removing paper dust even more effectively.

The inkjet recording apparatus 1 in the present embodiment is capable of increasing the area of at least one of mouths of the narrow gap 35*a* (mouths from which air flows into the narrow gap 35*a* from surrounding space). The mouths of the narrow gap 35*a* include an upstream mouth, a downstream mouth, and lateral mouths, for example. The inkjet recording apparatus 1 in the present embodiment is capable of increasing the area of the upstream mouth.

The upstream mouth herein is an inlet located at an upstream end of the narrow gap 35*a* in the conveyance direction of the sheet P, in other words, a space below an upstream edge of the plate member 35 in the conveyance direction of the sheet P. The downstream mouth is an inlet located at a downstream end of the narrow gap 35*a* in the conveyance direction of the sheet P, in other words, a space below a downstream edge of the plate member 35 in the conveyance direction of the sheet P. The lateral mouths are inlets located on opposite sides of the narrow gap 35*a* in a direction perpendicular to the conveyance direction of the sheet P, in other words, spaces below the opposite edges of the plate member 35 in the direction perpendicular to the conveyance direction of the sheet P. Structure for increasing the area of the mouth of the narrow gap 35*a* will be described later in detail with reference to FIG. 9.

Figure 4:
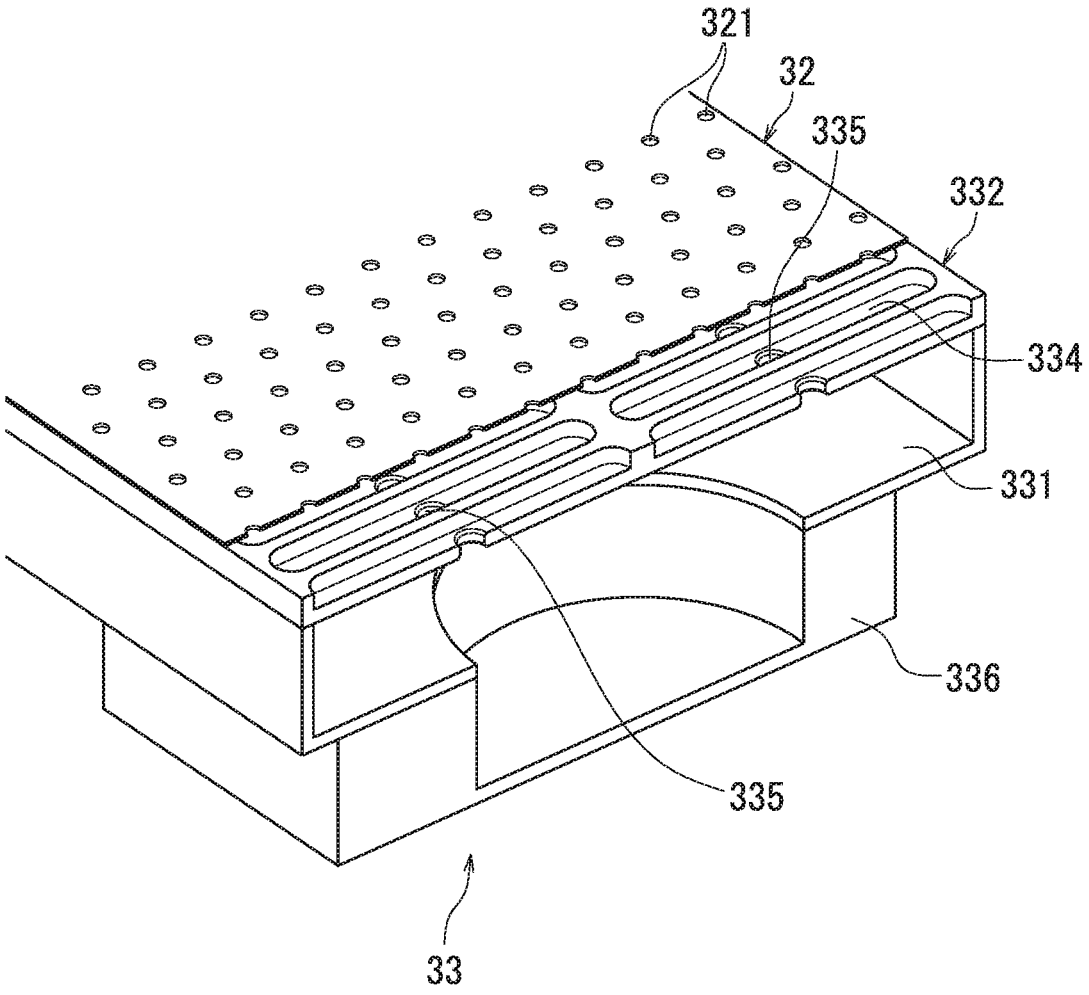
FIG. 4 is a cross sectional perspective view illustrating structure of a conveyor belt, a guide member, and a negative pressure applying section illustrated in FIG. 2.

Structure of the conveyor belt 32, the guide member 332, and the negative pressure applying section 33 will be described next with reference to FIG. 4. FIG. 4 is a cross sectional perspective view illustrating the structure of the conveyor belt 32, the guide member 332, and the negative pressure applying section 33 illustrated in FIG. 2.

As illustrated in FIG. 4, the conveyor belt 32, the guide member 332, the airflow chamber 331, and the negative pressure creating section 336 are located in order from top to bottom. The conveyor belt 32 has a plurality of suction holes 321 perforated therethrough.

The following describes the suction holes 321 in the conveyor belt 32. As illustrated in FIG. 4, the suction holes 321 are formed in the conveyor belt 32 at substantially equal intervals. The suction holes 321 each have a diameter of, for example, 2 mm. The spacing between adjacent suction holes 321 is, for example, 8 mm.

The guide member 332 has a plurality of grooves 334 in the upper surface (surface facing toward the conveyor belt 32). The grooves 334 each have a shape of an oval elongated in the conveyance direction of the sheet P.

Figure 5:
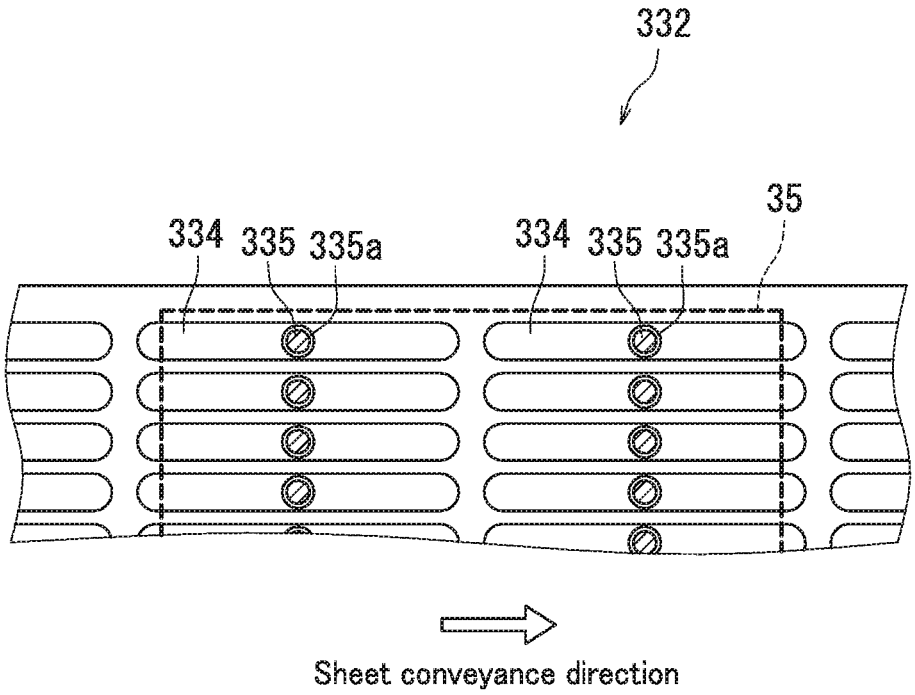
FIG. 5 is a plan view illustrating structure of the guide member illustrated in FIG. 4.

With reference to FIG. 5, the following describes the grooves 334 and the through holes 335 formed in the guide member 332. FIG. 5 is a plan view illustrating structure of the guide member 332 illustrated in FIG. 4. As illustrated in FIG. 5, the guide member 332 has the grooves 334 each having a shape of an oval elongated in the conveyance direction of the sheet P (horizontal direction in FIG. 5). The grooves 334 are arranged in a plurality of rows that are next to one another in the width direction of the guide member 332 (vertical direction in FIG. 5). Each groove 334 has a through hole 335 that penetrates the guide member 332 in the thickness direction thereof substantially at the center of the groove 334 in the conveyance direction of the sheet P (the horizontal direction in FIG. 5). Each through hole 335 is substantially circular in cross section.

FIG. 5 indicates, in dashed lines, a projected position of the plate member 35 on the guide member 332. The projected image of the plate member 35 on the guide member 332 overlaps with two columns of through holes 335, one at an upstream side in the conveyance direction of the sheet P (left in FIG. 5) and the other at a downstream side (right in FIG. 5). The grooves 334 containing the through holes 335 that are in the upstream column in the conveyance direction of the sheet P (to the left in FIG. 5) each extend further upstream beyond the upstream edge (left edge in FIG. 5) of the projected image of the plate member 35. Similarly, the grooves 334 containing the through holes 335 that are in the downstream column in the conveyance direction of the sheet P (to the right in FIG. 5) each extend further downstream beyond the downstream edge (right edge in FIG. 5) of the projected image of the plate member 35.

Figure 6A:
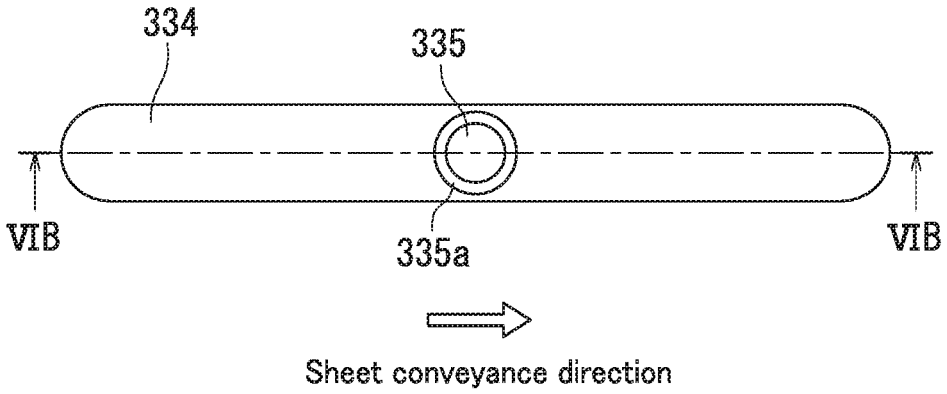
FIG. 6A is a plan view illustrating structure of a groove and a through hole formed in the guide member illustrated in FIG. 5.
Figure 6B:
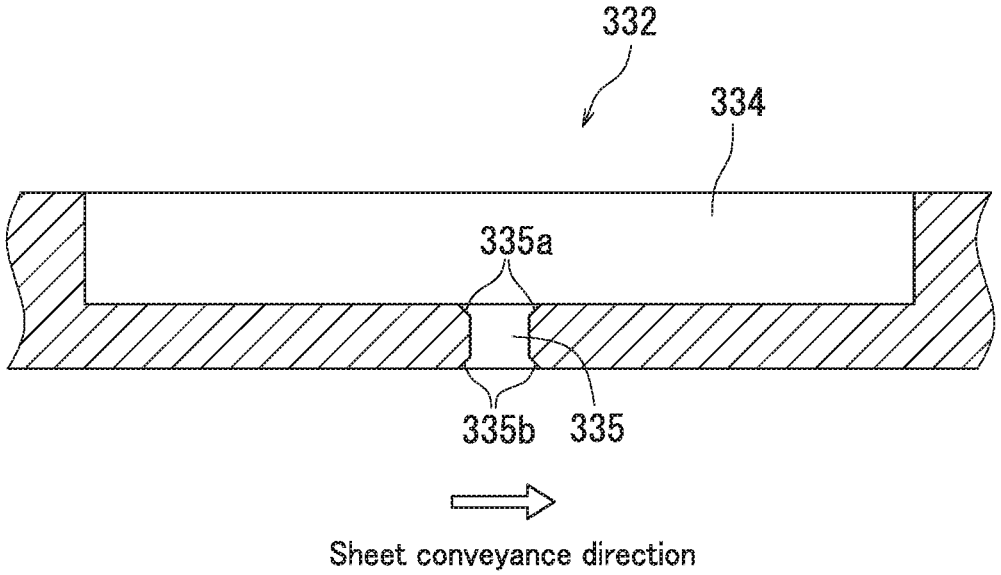
FIG. 6B is a cross sectional view of the groove and the through hole taken along a line VIB-VIB in FIG. 6A.

The grooves 334 and the through holes 335 located in the guide member 332 will be described next with reference to FIGS. 6A and 6B. FIG. 6A is a plan view illustrating structure of a groove 334 and a through hole 335 in the guide member illustrated in FIG. 5. FIG. 6B is a cross sectional view of the groove 334 and the through hole 335 taken along a line VIB-VIB in FIG. 6A.

As illustrated in FIG. 6A, the groove 334 has the through hole 335 that penetrates the guide member 332 in the thickness direction thereof substantially at the center of the groove 334 in the conveyance direction of the sheet P (horizontal direction in FIG. 6A). As illustrated in FIG. 6B, the groove 334 is continuous with the through hole 335, and therefore, negative pressure created in the airflow chamber 331 affects an inner region of the groove 334 through the through hole 335. The through hole 335 has a tapered portion 335*a* formed at an upper mouth and a tapered portion 335*b* formed at a lower mouth.

As described above, the grooves 334 are located in a region opposite to the plate member 35. Therefore, negative pressure created in the airflow chamber 331 affects the inner regions of the grooves 334 through the through holes 335. This can further facilitate flow of air along the paths indicated by the arrows FD1 and FD2 indicated in FIG. 3. Consequently, more effective removal of paper dust is enabled.

As described above, the tapered portion 335*a* at the upper mouth and the tapered portion 335*b* at the lower mouth of each through hole 335 are effective to reduce pressure loss of air flowing through the through hole 335. This can further facilitate flow of air along the paths indicated by the arrows FD1 and FD2 indicated in FIG. 3. Consequently, more effective removal of paper dust is enabled.

The present embodiment is directed to a configuration in which each through hole 335 has both the tapered portions 335*a* and 335*b* respectively at the upper mouth and the lower mouth. Alternatively, however, each through hole 335 may have one tapered portion at either the upper or lower mouth.

Referring back to FIG. 4, a description will be given of the relative positions of the suction holes 321 in the conveyor belt 32 and the grooves 334 in the guide member 332. The conveyor belt 32 has the suction holes 321 arranged in a plurality of rows in the conveyance direction of the sheet P. The rows of suction holes 321 are next to one another in the width direction of the conveyor belt 32 (direction perpendicular to the conveyance direction of the sheet P) such that the suction holes 321 in adjacent rows are staggered. As illustrated in FIG. 4, the respective rows of the suction holes 321 in the conveyor belt 32 are located opposite to the rows of the grooves 334 in the guide member 332.

Each groove 334 is arranged so as to be opposite to at least two of the suction holes 321 at all times. The suction holes 321 that are opposite to the grooves 334 change one-by-one as the conveyor belt 32 circulates.

The airflow chamber 331, which is under negative pressure created by the negative pressure creating section 336, is in communication with the suction holes 321 in the conveyor belt 32 through the through holes 335 and the grooves 334 of the guide member 332.

Therefore, negative pressure is applied to the suction holes 321 of the conveyor belt 32 and thus the conveyor belt 32 can convey a sheet P with the sheet P sucked onto the conveyor belt 32.

Figure 7:
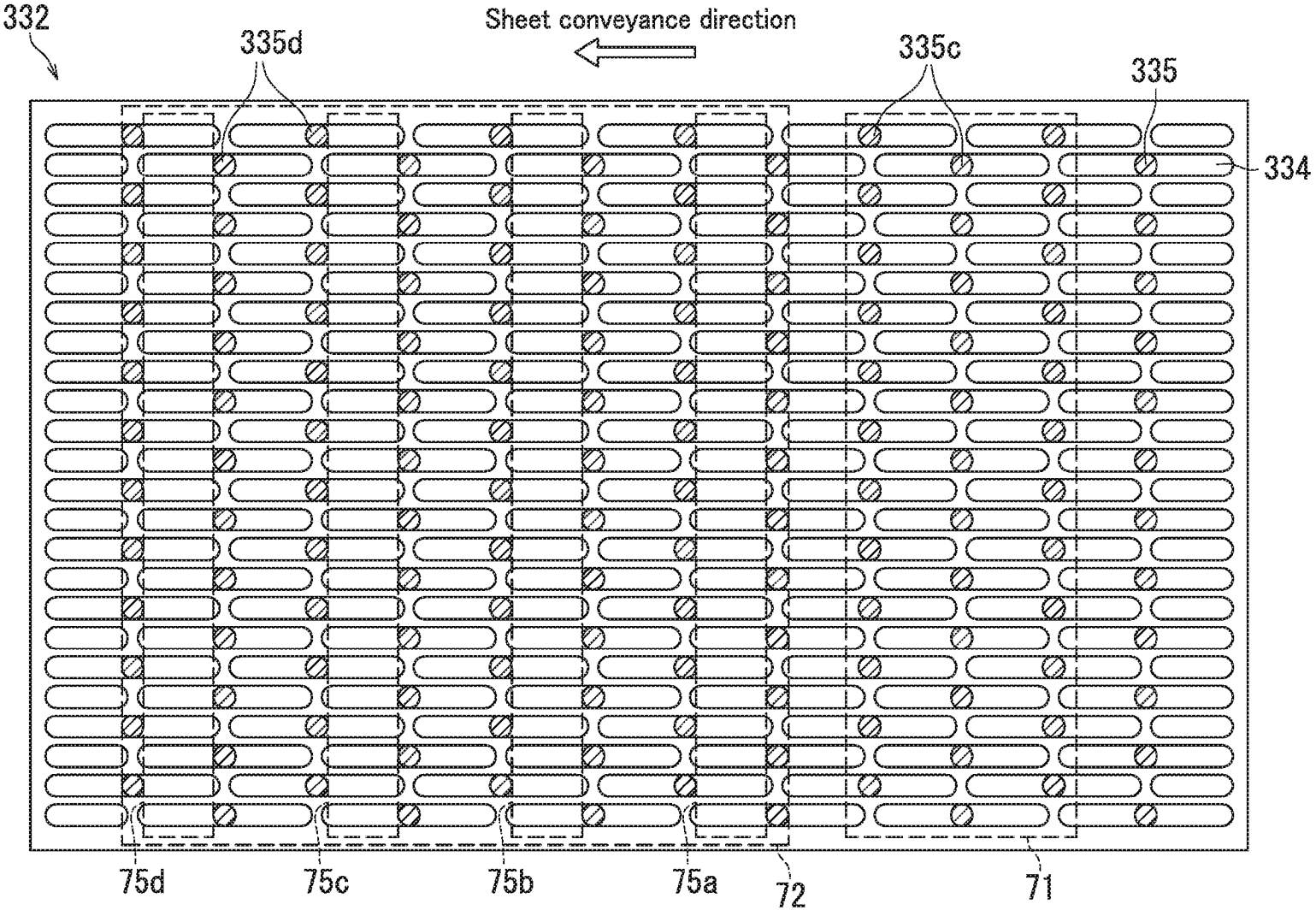
FIG. 7 is a plan view of the guide member illustrated in FIG. 2.

FIG. 7 is a plan view of the guide member 332 (upper wall of the airflow chamber 331) in FIG. 2.

Rectangular regions 75 (75*a*. 75*b*, 75*c*, and 75*d*) in FIG. 7 are regions of the guide member 332 that are located opposite to the respective recording heads 34 (hereinafter referred to as head facing regions). The conveyor belt 32 is located between the recording heads 34 and the guide member 332. More precisely, the head facing regions 75 are regions of the guide member 332 that face the respective recording heads 34 with the conveyor belt 32 therebetween. The head facing region 75*a* faces the recording head 34*a*. The head facing region 75*b* faces the recording head 34*b*. The head facing region 75*c* faces the recording head 34*c*. The head facing region 75*d* faces the recording head 34*d*.

Note that the image forming section 3 in the present embodiment includes a single recording head 34 for each of the four types but may include a plurality of recording heads 34 of each of the four types. In a configuration with a plurality of recording heads 34 of each type, the recording heads 34 of each type are staggered in the width direction of the guide member 332 (direction perpendicular to the conveyance direction of the sheet P).

Referring to FIG. 7, a rectangular region 71 is a given region of the guide member 332 located upstream of the head facing regions 75 in the conveyance direction of the sheet P (to the right in FIG. 7). Hereinafter, the given region is referred to as a "first region". The first region 71 in the present embodiment corresponds to a region where the plate member 35 is located, that is, a region opposite to the plate member 35 with the conveyor belt 32 therebetween. In other words, the narrow gap 35*a* is located above the first region 71.

Referring further to FIG. 7, a rectangular region 72 is located downstream of the first region 71 in the conveyance direction of the sheet P (to the left in FIG. 7) and includes the head facing regions 75. Hereinafter, the rectangular region 72 is referred to as a "second region". Ink ejection toward the sheet P (image formation) is performed above the second region 72. Hereafter, a space above the second region 72 in which image formation is performed is referred to as an "image formation space".

The inkjet recording apparatus 1 can adjust negative pressure applied through first through holes 335 located in the first region 71 among the through holes 335, that is, negative pressure applied to the narrow gap 35*a* by controlling the operating rate of the negative pressure creating section 336 (rotational speed of each fan in a configuration in which the negative pressure creating section 336 includes fans). The inkjet recording apparatus 1 in the present embodiment sets the negative pressure that is applied to the narrow gap 35*a* to be greater in maintenance than in image formation.

The inkjet recording apparatus 1 can adjust either or both of the number and the opening area of the first through holes 335*c*. Structure for adjusting either or both the number and the opening area of the first through holes 335*c* will be described later in detail with reference to FIG. 10.

Figure 8:
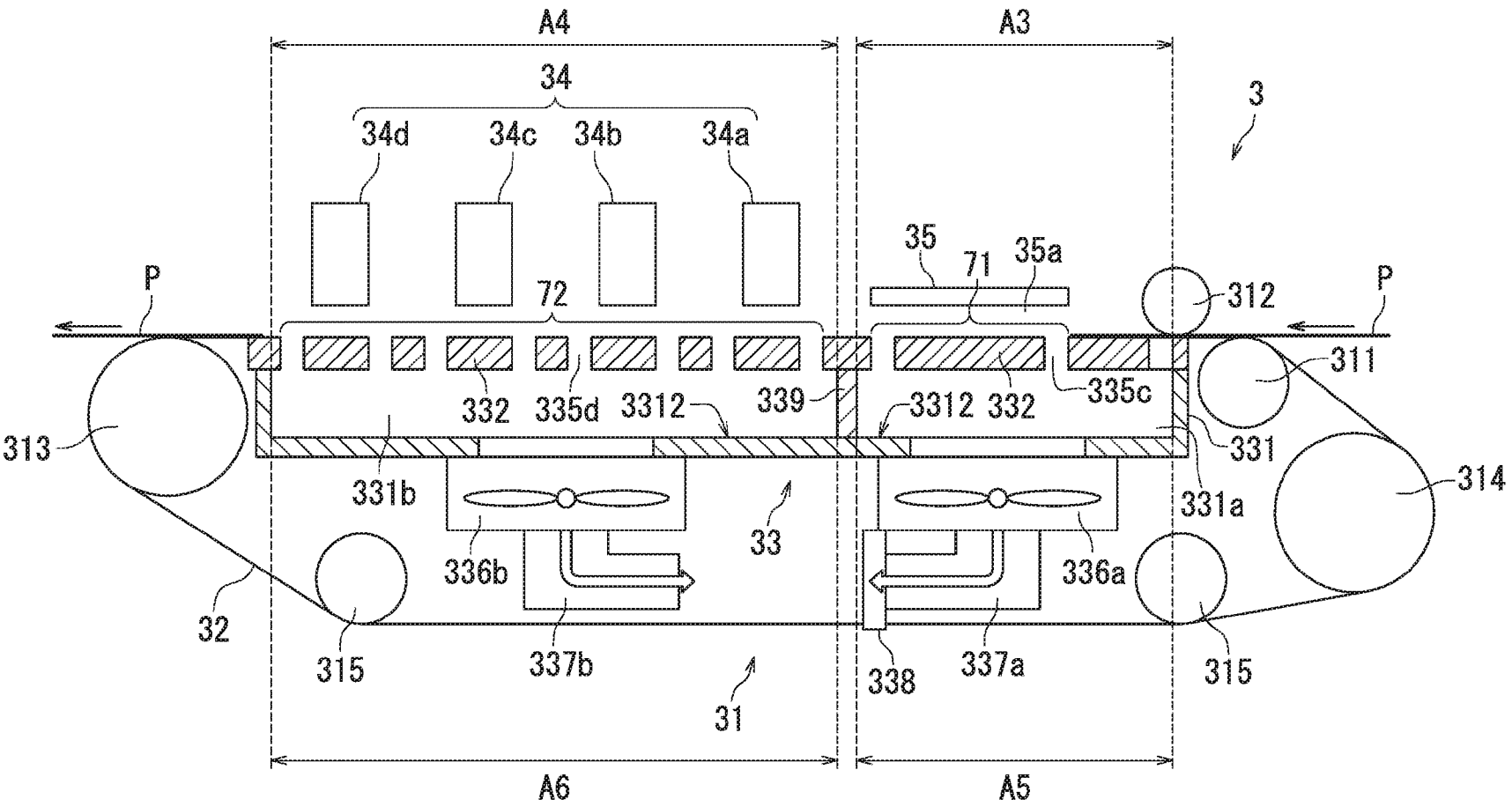
FIG. 8 is a diagram illustrating a second example of the structure of the image forming section illustrated in FIG. 1.

FIG. 8 is a diagram illustrating a second example of the structure of the image forming section 3 illustrated in FIG. 1.

FIG. 8 is for depicting the structure of the airflow chamber 331 partitioned into two spaces and does not illustrate some of the elements of configuration in the image forming section 3. In one example, the negative pressure applying section 33 includes a through hole control mechanism 330, which will be described later. The plate member 35 includes a movable portion 352, which will be described later. The through holes 335 each are located in a bottom surface of a corresponding one of the grooves 334 in the upper surface of the guide member 332.

As illustrated in FIG. 8, the airflow chamber 331 (the negative pressure creation space 3311) is partitioned by a partition plate 339 into a first space 331*a* located in correspondence with the first region 71 and a second space 331*b* located in correspondence with the second region 72. A portion A3 of the guide member 332 (upper wall) that forms the first space 331*a* includes the first region 71. In the above configuration, negative pressure created in the first space 331*a* causes air to be sucked through the first through holes 335*c* located in the first region 71. In other words, negative pressure created in the first space 331*a* is applied to the narrow gap 35*a*.

A portion A4 of the guide member 332 (upper wall) that forms the second space 331*b* includes the second region 72. In the above configuration, negative pressure created in the second space 331*b* causes air to be sucked through second through holes 335*d* located in the second region 72. In other words, negative pressure created in the second space 331*b* is applied to the image formation space.

The negative pressure applying section 33 includes two negative pressure creating sections 336 (a first negative pressure creating section 336*a* and a second negative pressure creating section 336*b*) and two gas outlets 337 (a first gas outlet 337*a* and a second gas outlet 337*b*). The first negative pressure creating section 336*a* is connected to the bottom surface 3312 of a portion A5 of the airflow chamber 331 that forms the first space 331*a*. The second negative pressure creating section 336*b* is connected to a portion A6 of the bottom surface 3312 of the airflow chamber 331 that forms the second space 331*b*.

The first negative pressure creating section 336*a* discharges air outward of the first space 331*a* from the first gas outlet 337*a* to create negative pressure in the first space 331*a*. The second negative pressure creating section 336*b* discharges air outward of the second space 331*b* from the second gas outlet 337*b* to create negative pressure in the second space 331*b*.

The inkjet recording apparatus 1 in the present embodiment operates the first negative pressure creating section 336*a* to apply negative pressure to the narrow gap 35*a* in maintenance. The inkjet recording apparatus 1 sets the operating rate of the first negative pressure creating section 336*a* to be greater in maintenance than in image formation. In consequence, the inkjet recording apparatus 1 sets negative pressure applied to the narrow gap 35*a* to be greater in maintenance than in image formation.

A collection member 338 for collecting foreign matter such as paper dust is disposed at a downstream end of the first gas outlet 337*a* in a direction of airflow. The collection member 338 may be a filter, for example. The collection member 338 collects paper dust mixed with air that is to be discharged outward of the first space 331*a*. In the above configuration, a situation in which paper dust sucked in the first space 331*a* is discharged from the first gas outlet 337*a* and scattered in the inkjet recording apparatus 1 can be prevented. Note that another collection member 338 may be disposed at the downstream end of the second gas outlet 337*b* in a direction of airflow, in addition to the collection member 338.

Figure 9:
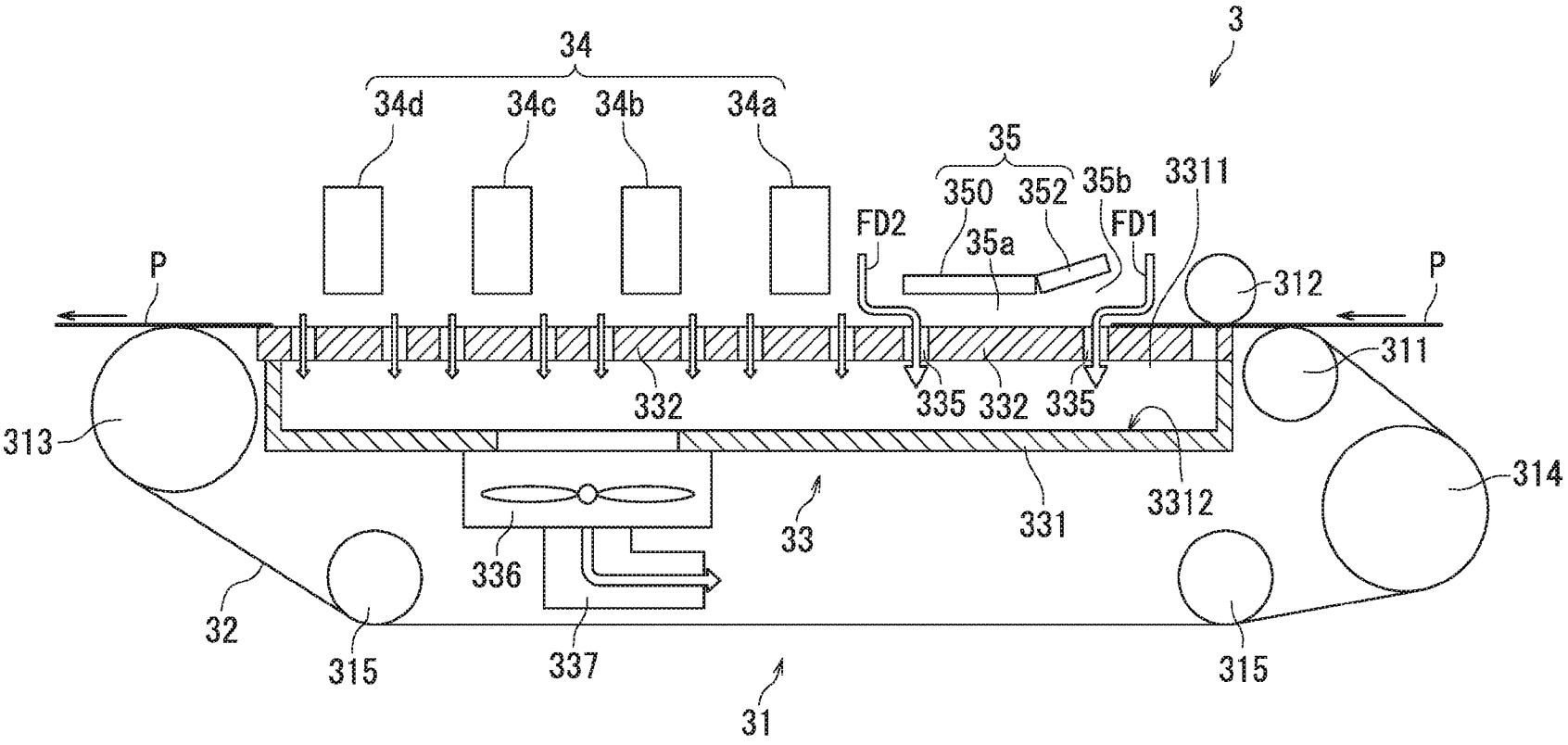
FIG. 9 is a diagram illustrating a third example of the structure of the image forming section illustrated in FIG. 1.

FIG. 9 is a diagram illustrating a third example of the structure of the image forming section 3 illustrated in FIG. 1.

FIG. 9 is for depicting the structure for increasing the area of the mouth of the narrow gap 35*a* and does not illustrate some of the elements of configuration in the image forming section 3. In one example, the airflow chamber 331 is partitioned into the two spaces, as illustrated in FIG. 8. The negative pressure applying section 33 includes the through hole control mechanism 330, which will be described later. The through holes 335 each are located in a bottom surface of a corresponding one of the grooves 334 in the upper surface of the guide member 332.

As illustrated in FIG. 9, the plate member 35 includes a main portion 350 and the movable portion 352 (first control mechanism). In the present embodiment, the movable portion 352 is an upstream portion of the plate member 35 in the conveyance direction of the sheet P and controls the area of an upstream mouth 35*b* of the narrow gap 35*a*. The movable portion 352 is a plate-shaped member similarly to the main portion 350.

The movable portion 352 turns about a first edge thereof as an axis under control of a control section 6 (see FIG. 1) to raise or lower a second edge thereof. The first edge of the movable portion 352 is located on a side of the main portion 350 (downstream side in the conveyance direction of the sheet P). The second edge of the movable portion 352 is located on an opposite side to the main portion 350 (upstream side in the conveyance direction of the sheet P). The inkjet recording apparatus 1 raises the second edge of the movable portion 352 to increase the area of the upstream mouth 35*b* of the narrow gap 35*a*. By contrast, the inkjet recording apparatus 1 lowers the second edge of the movable portion 352 to return the area of the upstream mouth 35*b* of the narrow gap 35*a* to the original area.

Figure 10:
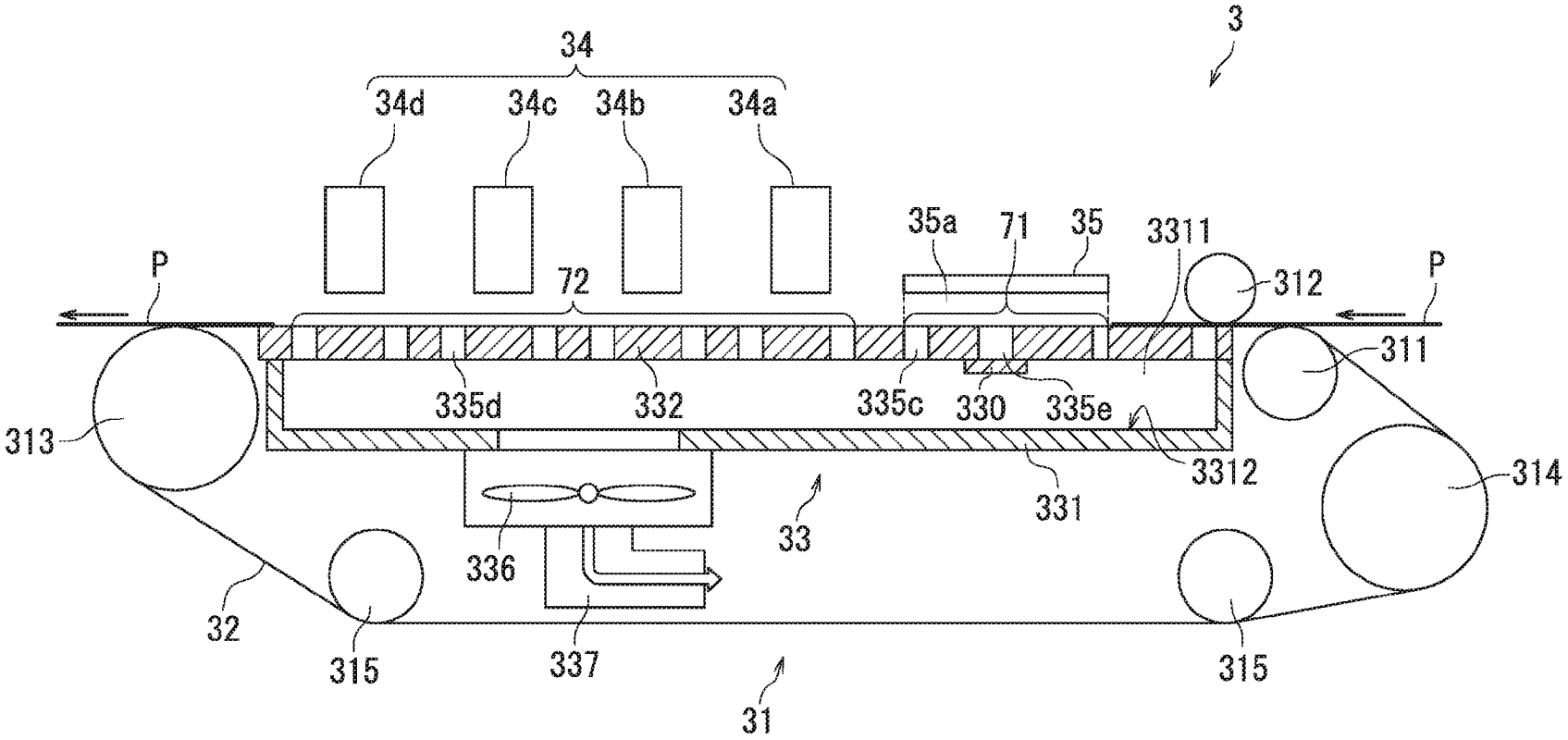
FIG. 10 is a diagram illustrating a fourth example of the structure of the image forming section illustrated in FIG. 1.

FIG. 10 is a diagram illustrating a fourth example of the structure of the image forming section 3 illustrated in FIG. 1.

FIG. 10 is for depicting the structure for adjusting either or both the number and the opening area of the first through holes 335*c* and does not illustrate some of the elements of configuration in the image forming section 3. In one example, the airflow chamber 331 is partitioned into the two spaces, as illustrated in FIG. 8. The plate member 35 includes the movable portion 352. The through holes each are located in a bottom surface of a corresponding one of the grooves 334 in the upper surface of the guide member 332.

As illustrated in FIG. 10, the negative pressure applying section 33 further includes a through hole control mechanism 330 (a second control mechanism). The through hole control mechanism 330 moves, for example, in a direction parallel to the conveyance direction of the sheet P (direction along the guide member 332) under control of the control section 6 to adjust either or both the number and the opening area of the first through holes 335*c*.

Specifically, the through hole control mechanism 330 moves along the guide member 332 between first and second positions under control of the control section 6. The first position is a position where the through hole control mechanism 330 blocks all of third through holes 335*e* (position illustrated in FIG. 10). The second position is a position where all of the third through holes 335*e* are exposed. The third through holes 335*e* are some of the first through holes 335*c*. When the inkjet recording apparatus 1 causes the through hole control mechanism 330 to move to the first position so as to block the third through holes 335*e*, the number of the first through holes 335*c* reduces. By contrast, when the inkjet recording apparatus 1 causes the through hole control mechanism 330 to move to the second position so as to expose the third through holes 335*e*, the number of the first through holes 335*c* increases.

Alternatively, the through hole control mechanism 330 may move along the guide member 332 between a third position and the second position under the control of the control section 6. The third position is a position where the through hole control mechanism 330 blocks part of the third through holes 335*e*. As the inkjet recording apparatus 1 causes the through hole control mechanism 330 to move from the third position to the second position, the opening area of the third through holes 335*e* (area of mouths of the third through holes 335*e* on a side of the airflow chamber 331 in the present embodiment) increases gradually. By contrast, as the inkjet recording apparatus 1 causes the through hole control mechanism 330 to move from the second position to the third position, the opening area of the third through holes 335*e* reduces gradually.

As illustrated in FIG. 1, the inkjet recording apparatus 1 further includes the control section 6. The control section 6 controls operation of the inkjet recording apparatus 1. The control section 6 includes a central processing unit (CPU) and a memory. The memory stores therein computer programs that the CPU executes, for example, firmware. Execution of computer programs in the memory by the CPU implements the function of the control section 6.

Figure 11:
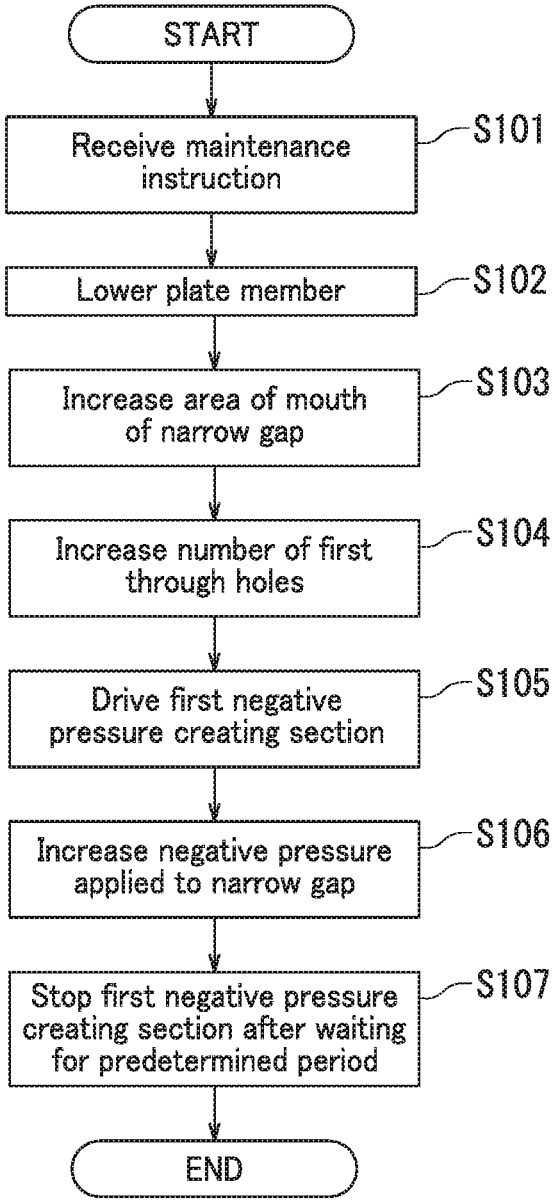
FIG. 11 is a flowchart depicting processing executed by a control section illustrated in FIG. 1.

Processing that the control section 6 performs will be described below with reference to FIG. 11. FIG. 11 is a flowchart depicting the processing performed by the control section 6 illustrated in FIG. 1.

First, upon receiving a maintenance instruction to clean the plate member 35 (Step S101), the control section 6 controls the raising and lowering mechanism to lower the plate member 35 (Step S102) so as to adjust the distance H to the second distance (for example, 1.5 mm) that is shorter than the first distance (2 mm in the present embodiment) to which the distance H is adjusted in image formation.

Shortening the distance H in maintenance can increase the flow velocity of air sucked into the narrow gap 35*a* (air flowing toward the airflow chamber 331) when compared to that in image formation. In the above configuration, paper dust attached to the plate member 35 can be effectively removed and collected into the airflow chamber 331 (first space 331*a*) in maintenance in the inkjet recording apparatus 1. When the distance H is too short in image formation, the plate member 35 may prevent conveyance of the sheet P. As such, it is not preferable to lower the plate member 35 too low in image formation.

The control section 6 then controls the movable portion 352 of the plate member 35 to raise the second edge of the movable portion 352, thereby increasing the area of the upstream mouth 35*b* of the narrow gap 35*a* (Step S103).

Increasing the area of the mouth of the narrow gap 35*a* (the upstream mouth 35*b* in the present embodiment) in maintenance can allow surrounding air to smoothly flow into the narrow gap 35*a*, thereby increasing the flow velocity of air sucked into the narrow gap 35*a* In the above configuration, paper dust attached to the plate member 35 can be effectively removed and collected into the airflow chamber 331 (first space 331*a*) in maintenance in the inkjet recording apparatus 1.

The control section 6 next controls the through hole control mechanism 330 to adjust the number of the first through holes 335*c* to a second number that is greater than a first number to which the number of the first through holes 335*c* is adjusted in image formation (Step S104). Specifically, the control section 6 moves the through hole control mechanism 330 from the first position to the second position to expose the third through holes 335*e*, thereby increasing the number of the first through holes 335*c*.

Alternatively, the control section 6 may control the through hole control mechanism 330 to adjust the opening area of the first through holes 335*c* (the third through holes 335*e* in the present embodiment) to a second area that is greater than a first area to which the opening area of the first through holes 335*c* is adjusted in image formation, rather than or in addition to control to increase the number of the first through holes 335*c*.

When either or both of the number and the opening area of the first through holes 335*c* are increased in maintenance, the flow velocity of air sucked into the narrow gap 35*a* increases. In the above configuration, paper dust attached to the plate member 35 can be effectively removed and collected into the airflow chamber 331 (the first space 331*a*) in maintenance in the inkjet recording apparatus 1.

Next, the control section 6 causes the first negative pressure crating section 336*a* to start applying negative pressure to the narrow gap 35*a* (Step S105). This causes air to be sucked into the narrow gap 35*a*. The sucked air cleans the plate member 35 to remove paper dust attached to the plate member 35.

The control section 6 sets the negative pressure that is applied to the narrow gap 35*a* (negative pressure applied through the first through holes 335*c*) to be greater than that in image formation (Step S106). Specifically, the control section 6 sets the operating rate of the first negative pressure creating section 336*a* to be greater than that in image formation.

When the negative pressure that is applied to the narrow gap 35*a* is set greater in maintenance than in image formation, the flow velocity of air sucked into the narrow gap 35*a* is greater in the maintenance than in image formation. In the above configuration, paper dust attached to the plate member 35 can be effectively removed and collect into the airflow chamber 331 (the first space 331*a*) in maintenance in the inkjet recording apparatus 1.

The control section 6 waits for a predetermined maintenance period (for example, several minutes) and then suspends the operation of the first negative pressure creating section 336*a* (Step S107). Then, the control section 6 terminates the processing depicted in FIG. 11.

The embodiment of the present disclosure has been described so far with reference to the drawings. However, the present disclosure is not limited to the above embodiment, and a wide range of alterations can be made to the embodiment so long as such alterations do not deviate from the intended scope of the present disclosure (for example, (1) to (5) below). The drawings are schematic illustrations that emphasize elements of configuration in order to facilitate understanding thereof. Therefore, properties of each of the elements, such as thickness, length, and number thereof, may differ from reality. The properties of each of the elements, such as shape and dimension thereof described above are mere examples and not specific limitations. A wide range of variations of the properties can be made to the embodiment so long as such variations do not deviate from the intended scope of the present disclosure.

(1) The control section 6 in the present embodiment performs the processing at Steps S102 to S107 in FIG. 11 upon receiving a maintenance instruction to clean the plate member 35. However, not all of Steps S102, S103, S104, and S106 may be necessarily performed. For example, the control section 6 may not perform Steps S103, S104 and S106.

(2) The inkjet recording apparatus 1 in the present embodiment has, but is not limited to, a configuration capable of increasing the area of the upstream mouth 35*b*. For example, the inkjet recording apparatus 1 may have a configuration capable of increasing the area of the downstream mouth rather than or in addition to that of the upstream mouth 35*b*. In the above configuration, either or both the upstream mouth 35*b* and the downstream mouth may be increased in area at Step S103 in FIG. 11.

(3) The present embodiment describes a configuration in which the conveyor belt 32 conveys a sheet P in the image forming section 3. Alternatively, however, the image forming section 3 may employ a different method for conveying a sheet P. For example, a plurality of conveyance rollers may be used to convey the sheet P. In this variation, negative pressure is preferably applied through a gap between adjacent conveyance rollers.

(4) The above embodiment describes a configuration in which the narrow gap 35*a* is formed by the plate member 35. This, however, should not be construed as limiting. The narrow gap 35*a* may be formed in another way. For example, the head base 37, which is located upstream of the recording heads 34 in the conveyance direction of the sheet P, may be provided with part extending toward the conveyor belt 32 so as to form the narrow gap 35*a*. This variation can simplify the structure.

Alternatively, instead of the plate member 35, a belt stretched around two rollers may be employed to form the narrow gap 35*a*. Specifically, this variation employs a drive roller, a driven roller, and an endless belt in such position that the endless belt stretched around the drive roller and the driven roller is substantially parallel to the upper surface of the conveyor belt 32. The narrow gap 35*a* is formed between the lower surface of the endless belt and the upper surface of the conveyor belt 32. In this variation, once a region of the endless belt located on a lower side is contaminated with paper dust, the endless belt can be circulated to position a region not yet contaminated with paper dust on the lower side. This can effectively reduce the required frequency of paper dust removal from the endless belt by, for example, a service person.

(5) The above embodiment describes a configuration in which the guide member 332 and the airflow chamber 331 are separate components. The guide member 332 may be integral with the airflow chamber 331. This variation enables prevention of unintentional release of negative pressure from the airflow chamber 331 (air flowing into the airflow chamber 331 through a gap between the guide member 332 and the airflow chamber 331).

What is claimed is:

1. An inkjet recording apparatus comprising:

a control section;

a conveyance section having a conveying surface and configured to convey a recording medium while the recording medium is placed on the conveying surface;

a recording head configured to eject ink onto the recording medium being conveyed by the conveyance section;

a gap forming section that is disposed upstream of the recording head in a conveyance direction of the recording medium to form a gap with the conveying surface of the conveyance section; and a negative pressure applying section configured to apply negative pressure to the gap, wherein a distance across the gap in a direction perpendicular to the conveying surface is set so as to allow air flowing into the gap from surrounding space to have a higher flow velocity in the gap than before flowing into the gap, the control section adjusts the distance across the gap in the direction perpendicular to the conveying surface to a first distance in image formation, and upon receiving an instruction to clean the gap forming section, the control section adjusts the distance across the gap in the direction perpendicular to the conveying surface to a second distance that is shorter than the first distance, causes the negative pressure applying section to start applying negative pressure to the gap, and sets the negative pressure that is applied to the gap to be greater than the negative pressure that is applied to the gap in image formation.

2. The inkjet recording apparatus according to claim 1, wherein the negative pressure applying section includes:

an airflow chamber partitioned into a first space and a second space;

a first negative pressure creating section configured to create negative pressure in the first space; and a second negative pressure creating section configured to create negative pressure in the second space, negative pressure to be applied to the gap is created in the first space, negative pressure to be applied to a space where the recording head discharges ink is created in the second space, and upon receiving the instruction to clean the gap forming section, the control section causes the first negative pressure creating section to start operating for causing the negative pressure applying section to start applying negative pressure to the gap and sets the negative pressure created in the first space to be greater than the negative pressure created in the first space in image formation for setting the negative pressure that is applied to the gap to be greater than the negative pressure that is applied to the gap in image formation.

3. The inkjet recording apparatus according to claim 1, wherein the gap forming section is disposed to form the gap such that the distance across the gap in the direction perpendicular to the conveying surface of the conveyance section is equal to or shorter than a threshold distance that is set in advance.

4. The inkjet recording apparatus according to claim 1, wherein the gap forming section includes a plate member disposed opposite to the conveying surface of the conveyance section and having a flat surface substantially parallel to the conveying surface of the conveyance section.

5. The inkjet recording apparatus according to claim 4, wherein the plate member is an electrical conductor that is earthed.

6. The inkjet recording apparatus according to claim 4, further comprising a head base configured to support the recording head, wherein the plate member is secured to the head base, and the head base has a hole located upstream of the plate member in the conveyance direction of the recording medium and another hole located downstream of the plate member in the conveyance direction of the recording medium that allow air to flow into the gap.

7. The inkjet recording apparatus according to claim 4, wherein the plate member includes a tapered portion such that the distance across the gap in the direction perpendicular to the conveying surface of the conveyance section is greater toward an edge of the plate member in the conveyance direction of the recording medium.

8. An inkjet recording apparatus comprising:

a control section;

a conveyance section having a conveying surface and configured to convey a recording medium while the recording medium is placed on the conveying surface;

a recording head configured to eject ink onto the recording medium being conveyed by the conveyance section;

a gap forming section that is disposed upstream of the recording head in a conveyance direction of the recording medium to form a gap with the conveying surface of the conveyance section;

a negative pressure applying section configured to apply negative pressure to the gap; and a first control mechanism configured to control an area of a mouth of the gap, wherein a distance across the gap in a direction perpendicular to the conveying surface is set so as to allow air flowing into the gap from surrounding space to have a higher flow velocity in the gap than before flowing into the gap, the control section adjusts the distance across the gap in the direction perpendicular to the conveying surface to a first distance in image formation, and upon receiving an instruction to clean the gap forming section, the control section adjusts the distance across the gap in the direction perpendicular to the conveying surface to a second distance that is shorter than the first distance, causes the negative pressure applying section to start applying negative pressure to the gap, and causes the first control mechanism to increase the area of the mouth of the gap.

9. The inkjet recording apparatus according to claim 8, wherein the gap forming section is disposed to form the gap such that the distance across the gap in the direction perpendicular to the conveying surface of the conveyance section is equal to or shorter than a threshold distance that is set in advance.

10. The inkjet recording apparatus according to claim 8, wherein the gap forming section includes a plate member disposed opposite to the conveying surface of the conveyance section and having a flat surface substantially parallel to the conveying surface of the conveyance section.

11. The inkjet recording apparatus according to claim 10, wherein the plate member is an electrical conductor that is earthed.

12. The inkjet recording apparatus according to claim 10, further comprising a head base configured to support the recording head, wherein the plate member is secured to the head base, and the head base has a hole located upstream of the plate member in the conveyance direction of the recording medium and another hole located downstream of the plate member in the conveyance direction of the recording medium that allow air to flow into the gap.

13. The inkjet recording apparatus according to claim 10, wherein the plate member includes a tapered portion such that the distance across the gap in the direction perpendicular to the conveying surface of the conveyance section is greater toward an edge of the plate member in the conveyance direction of the recording medium.

14. The inkjet recording apparatus according to claim 8, wherein the control section turns the first control mechanism about a downstream edge of the first control mechanism in the conveyance direction of the recording medium as an axis.

15. An inkjet recording apparatus comprising:

a control section;

a conveyance section having a conveying surface and configured to convey a recording medium while the recording medium is placed on the conveying surface;

a recording head configured to eject ink onto the recording medium being conveyed by the conveyance section;

a gap forming section that is disposed upstream of the recording head in a conveyance direction of the recording medium to form a gap with the conveying surface of the conveyance section; and a negative pressure applying section configured to apply negative pressure to the gap, wherein a distance across the gap in a direction perpendicular to the conveying surface is set so as to allow air flowing into the gap from surrounding space to have a higher flow velocity in the gap than before flowing into the gap, the negative pressure applying section includes:

an airflow chamber that has an upper wall having a plurality of holes and in which the negative pressure is created, the negative pressure applying section applying the negative pressure through the holes in the upper wall of the airflow chamber and the holes in the conveying surface of the conveyance section; and a second control mechanism configured to adjust either or both the number and an opening area of holes in a region of the upper wall of the airflow chamber among the holes in the upper wall and the conveying surface, the region of the upper wall is located opposite to the gap forming section with the conveying surface of the conveyance section therebetween, the number of the holes in the region is adjusted to a first number in image formation, the opening area of the holes in the region is adjusted to a first opening area in image formation, the control section adjusts the distance across the gap in the direction perpendicular to the conveying surface to a first distance in image formation, and upon receiving an instruction to clean the gap forming section, the control section adjusts the distance across the gap in the direction perpendicular to the conveying surface to a second distance that is shorter than the first distance, causes the negative pressure applying section to start applying negative pressure to the gap, and controls the second control mechanism to increase either or both the number and the opening area of the holes in the region by adjusting the number of the holes in the region to a second number that is greater than the first number or the opening area of the holes in the region to a second opening area that is greater than the first opening area.

16. The inkjet recording apparatus according to claim 15, wherein the gap forming section is disposed to form the gap such that the distance across the gap in the direction perpendicular to the conveying surface of the conveyance section is equal to or shorter than a threshold distance that is set in advance.

17. The inkjet recording apparatus according to claim 15, wherein the gap forming section includes a plate member disposed opposite to the conveying surface of the conveyance section and having a flat surface substantially parallel to the conveying surface of the conveyance section.

18. The inkjet recording apparatus according to claim 17, wherein the plate member is an electrical conductor that is earthed.

19. The inkjet recording apparatus according to claim 17, further comprising a head base configured to support the recording head, wherein the plate member is secured to the head base, and the head base has a hole located upstream of the plate member in the conveyance direction of the recording medium and another hole located downstream of the plate member in the conveyance direction of the recording medium that allow air to flow into the gap.

20. The inkjet recording apparatus according to claim 17, wherein the plate member includes a tapered portion such that the distance across the gap in the direction perpendicular to the conveying surface of the conveyance section is greater toward an edge of the plate member in the conveyance direction of the recording medium.

* * * * *